US005344340A

United States Patent [19]

Bouleau

[11] Patent Number: 5,344,340

[45] Date of Patent: Sep. 6, 1994

[54] COAXIAL CONNECTOR FOR CONNECTING TWO PRINTED-CIRCUIT BOARDS

[75] Inventor: Jacky Bouleau, Villeparisis, France

[73] Assignee: Radiall, Rosny-sous-Bois, France

[21] Appl. No.: 990,419

[22] Filed: Dec. 15, 1992

[30] Foreign Application Priority Data

Dec. 18, 1991 [FR] France ..... 91 15711

[51] Int. Cl.[5] ..... H01R 17/04

[52] U.S. Cl. ..... 439/581; 439/63

[58] Field of Search ..... 439/578–585, 439/675, 63

[56] References Cited

U.S. PATENT DOCUMENTS

| | | | |
|---|---|---|---|
| 4,548,453 | 10/1985 | Mummey et al. . | |
| 4,598,961 | 7/1986 | Cohen | 439/63 |
| 4,605,269 | 8/1986 | Cohen et al. | 439/63 |
| 4,666,231 | 5/1987 | Sheesley et al. | 439/581 |
| 4,795,352 | 1/1989 | Capp et al. . | |
| 4,875,865 | 10/1989 | Demier, Jr. et al. . | |
| 4,946,392 | 8/1990 | Kobler et al. | 439/63 |
| 4,964,805 | 10/1990 | Gabany | 439/63 |
| 5,055,068 | 10/1991 | Machura et al. | 439/581 |
| 5,088,937 | 2/1992 | Gabany . | |
| 5,169,343 | 12/1992 | Andrews | 439/63 |

FOREIGN PATENT DOCUMENTS 0256697 1/1987 European Pat. Off. .

*Primary Examiner*—David L. Pirlot

*Attorney, Agent, or Firm*—Schweitzer Cornman & Gross

[57] ABSTRACT

A coaxial connector of an elbowed coaxial connector element and a straight coaxial connector element, wherein the elbowed element has a conducting parallelepipedal body having a bottom face and a front face, a first printed-circuit board, a plurality of pins attached to the bottom face for mounting the elbowed element on the first printed-circuit board, a first coaxial contact mounted from the front face, the first coaxial contact has a first central conductor and a first peripheral conductor, the central conductor is concentrically disposed within the first peripheral conductor, a two ended, elbowed connecting rod one end of which is the first central conductor, and the other of its two ends is connected to one of the pins, the straight element has a second printed-circuit board, a ground plate connected to the second printed-circuit board, a second coaxial contact complementing the first coaxial contact whereby one of the coaxial contacts is a male contact and the other is a female contact, the second coaxial contact has a second central conductor and a second peripheral conductor, the second central conductor being concentrically disposed within said second peripheral conductor, a two ended connecting rod one end being the second central connector, and the other of its two ends being led directly or indirectly through the second printed-circuit board, and the second peripheral conductor is crimped to the ground plate.

2 Claims, 2 Drawing Sheets

COAXIAL CONNECTOR FOR CONNECTING TWO PRINTED-CIRCUIT BOARDS

BACKGROUND OF THE INVENTION

The present invention relates to a coaxial connector for connecting two printed-circuit boards, More precisely, the invention relates to a coaxial connector consisting of two connector elements capable of being fixed, each to one of the printed-circuit boards to be connected, the connector comprising a single ground plate for the two assembled connector elements.

SUMMARY OF THE PRESENT INVENTION

The coaxial connector according to the invention is noteworthy in that it includes a first, elbowed, coaxial connector element comprising a conducting parallelepipedal body having, on a lower face, pin contacts for mounting and connecting up the connector element on a printed-circuit board and, on a front face, at least one coaxial contact, an elbowed conducting rod connecting one of the pins projecting from the lower face of the body to the central conductor of the coaxial contact projecting from the front face of the body, and a second coaxial connector element comprising one, or alternatively two coaxial contacts complementary to the coaxial contact or contacts of said first, elbowed, coaxial connector element, capable of being mounted and connected up on a second printed-circuit board, said second coaxial connector element including a ground plate provided with orifices for the passage of the coaxial contact or contacts, the or each coaxial contact being fixed by crimping the end of its outer conducting socket to said ground plate.

According to the invention, provision is advantageously made for producing the conducting body of the first connector element from a single piece, especially by molding or machining, said body including, for receiving the elbowed conducting rod, an L-shaped conduit emerging into the lower face and into the front face of the body, said conduit furthermore emerging via a slot in to the rear face of the body, said slot being closed off by a cap fixed to the body, especially by crimping, after installing the elbowed conducting rod in said conduit through said slot.

In order to produce a double coaxial connector element, the body furthermore includes a second L-shaped conduit emerging into the lower face of the body and into its front face in order to receive a second elbowed rod connecting another connection pin at the printed-circuit board to the central conductor of a second coaxial contact projecting from the front face of the body.

This ground plate, which may be obtained by cutting and bending a metal sheet, constitutes a single ground plane for the two assembled connector elements.

For the purpose of making the invention easier to understand, an entirely non-limiting embodiment will now be described by referring to the attached drawing, in which:

DETAILED DESCRIPTION OF THE INVENTION

Figure 1:
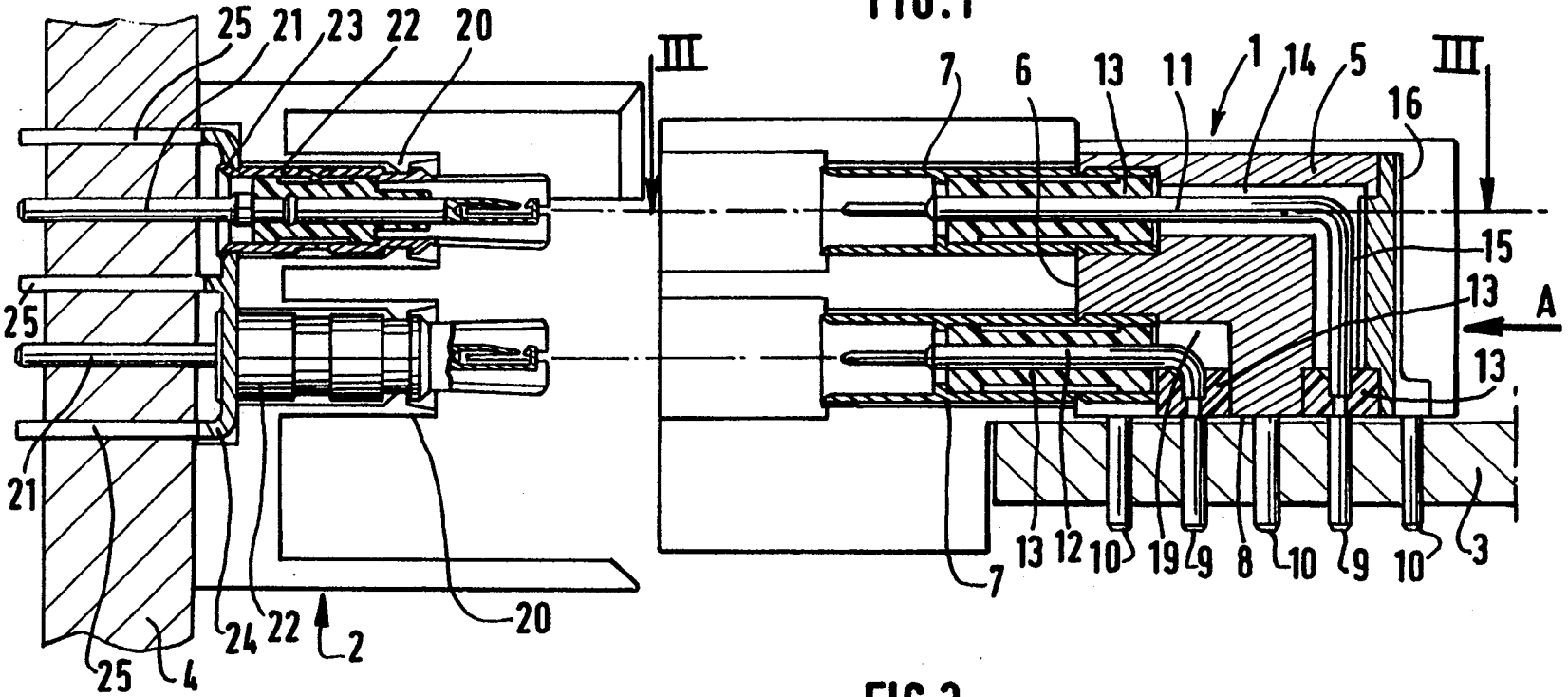
FIG. 1 shows, in partial cross section, a connector according to the invention in the disconnected state, including an elbowed double coaxial connector element and an associated complementary connector element.

FIG. 1 illustrates a connector consisting of an elbowed coaxial connector element, designated overall by 1, and of a straight coaxial connector element, designated overall by 2.

Each of the connector elements 1 and 2 is shown mounted on a printed-circuit board, the elbowed connector element 1 being, in the embodiment illustrated, mounted on a printed-circuit daughterboard 3 and the connector element 2 being mounted on a printed-circuit motherboard 4.

The connector element 1 comprises, according to the invention, a conducting parallelepipedal body 5 made from a single piece, the body 5 being able to be produced, for example, by molding a metal or a metallic alloy such as the zinc-aluminum alloy known by the name Zamak.

The elbowed coaxial connector element 1 illustrated is of the double type and includes, projecting from the front face 6 of the body, two coaxial contacts 7 of the female type in the example illustrated.

The body 5 is capable of being fixed by its lower face 8 to the printed-circuit board 3 and includes, for this purpose, pin contacts 10.

The pins 9 are each connected via an elbowed conducting rod, respectively 11 and 12, to the central conductor of one of the coaxial contacts 7.

The pins 10 are connected to the connector body 5 and consequently to the outer conductors of the coaxial contacts 7.

Insulations 13 are interposed between the elbowed conducting rods 11 and 12 and the body 5, in particular in the region of the front face 6 and of the lower face 8 of the body.

According to the invention, the body 5 includes an L-shaped internal conduit including a branch 14 extending parallel to the lower and upper faces of the body and emerging into the front face 6, and a branch 15 parallel to the front and rear faces of the body and emerging into the lower face 8 of the latter.

The L-shaped internal conduit, defined by the branches 14 and 15, emerges via a slot 16 at the rear face of the body.

Figure 3:
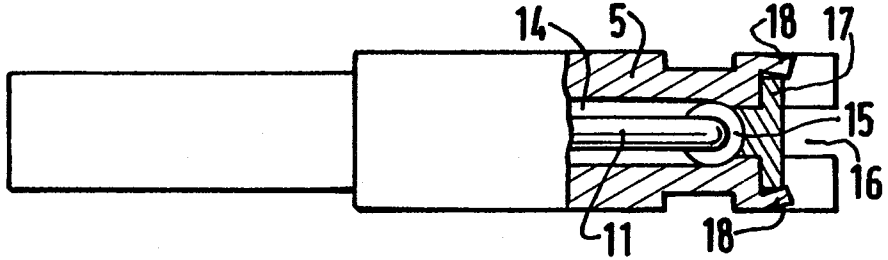
FIG. 3 is a side elevational view of the elbowed coaxial connector element in partial cross section taken along III—III of FIG. 1.
Figure 2:
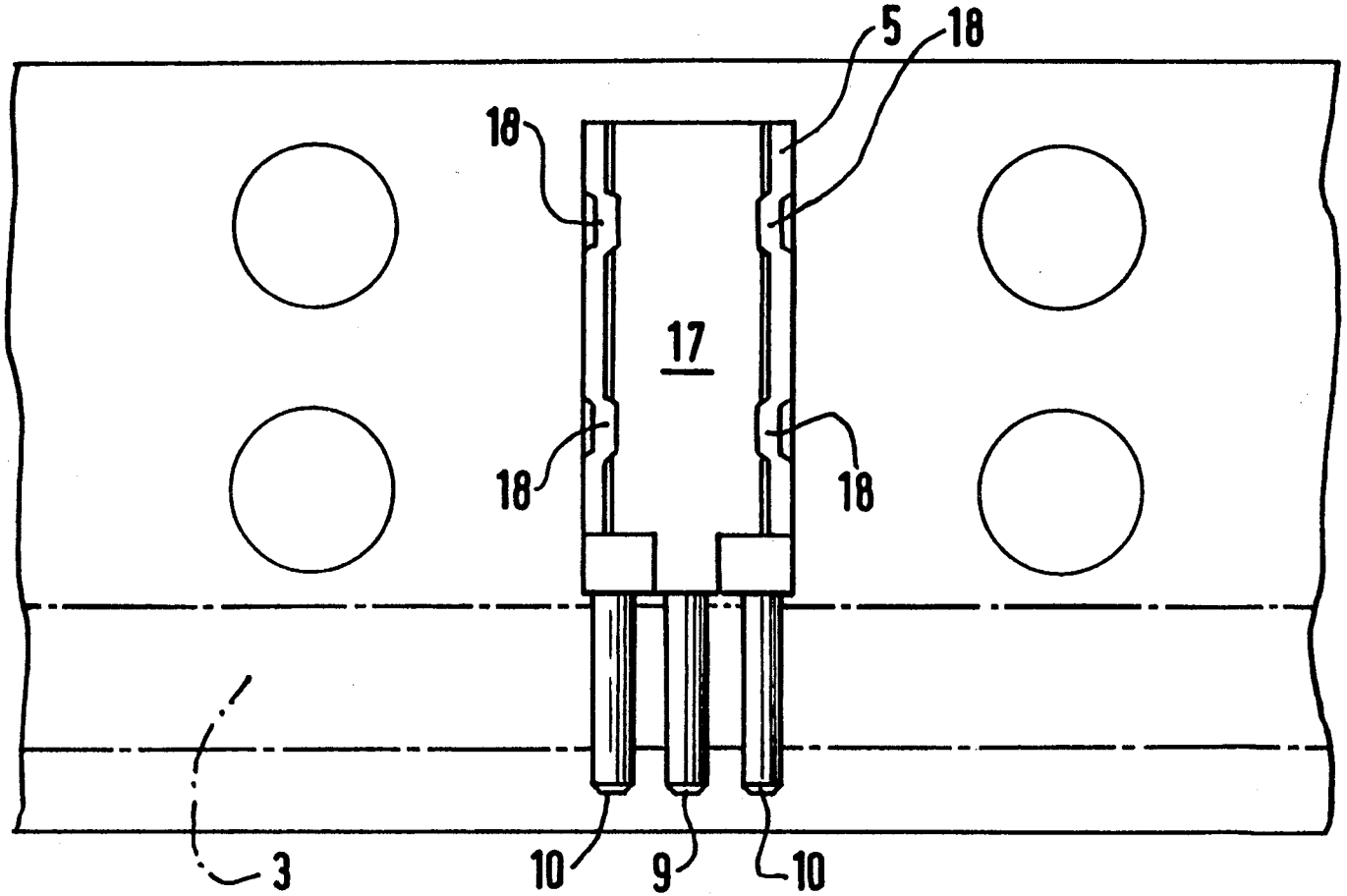
FIG. 2 is a rear view of the elbowed coaxial connector element in the direction of the arrow A of FIG. 1.

According to the invention, it is thus possible to introduce, via the rear of the body through the slot 16, an elbowed conducting rod 11 into the conduit formed by the branches 14 and 15, after which the rear end slot 16 is closed off by means of a cap 17 which, as FIG. 3 shows, has a substantially T-shaped cross section, said cap being immobilised by crimping resulting from localized deformation of the walls 18 of the body 5.

The body 5 furthermore includes, for receiving the second elbowed rod 12, a second L-shaped conduit 19 emerging into the front face 6 and into the lower face 8 of the body.

The complementary connector element 2 includes two coaxial contacts 20, of the male type in the example illustrated, complementary to the coaxial contacts 7, the central conductor of each of the coaxial contacts 20 being connected via a pin contact 21 to the printed-circuit board 4.

The outer conducting socket 22 of each coaxial contact 20 is fixed by crimping its end 23 into an orifice of a conducting plate 24, which is especially made from cut and bent metal sheet, said plate 24 including prolongations 25 for mounting it and connecting it to the printed-circuit board 4.

The board 24 constitutes a ground plate which, when the connector elements illustrated in FIG. 1 are assembled, constitutes a single ground plane for the connector produced.

Although the invention has been described in connection with a particular embodiment, it is very clear that it is in no way limited and that it is possible to provide various alternatives and modifications thereof without thereby departing either from its scope or its spirit.

I claim:

1. A twin coaxial connector for connecting a first printed circuit board generally perpendicular to a second printed circuit board and including an elbowed coaxial connector element and a straight coaxial connector element, (A) the elbowed coaxial connector element comprising:

(i) a conducting parallelepipedal body having a bottom face, a front face, and a rear face, (ii) a plurality of first pins attached to said bottom face for joining said body to the first printed circuit board, (iii) at least two first coaxial contacts on said front face, each contact having a first peripheral conductor in electrical communication with said body, and a first central conductor, (iv) at least two elbowed conducting rods passing through said body, connecting said first central conductors to said first pins, and (B) the straight coaxial connector element comprising:

(i) a ground plate having extensions for insertion into the second printed-circuit board, (ii) a plurality of second pins attached to the second printed circuit board, (iii) at least two second coaxial contacts for mating connection with said first coaxial contacts, each of said second coaxial contacts having a second central conductor in electrical contact with a second pin, and a second peripheral conductor, (iv) said ground plate defining orifices for receiving each of said second peripheral conductors therein, (v) crimped means formed on said second peripheral conductors to fasten the second peripheral conductors within said orifices to said ground plate.

2. The coaxial connector of claim 1, wherein (a) said conducting parallelepipedal body is a unitary element and contains at least two substantially L-shaped conduits communicating between said front face and said bottom face, (b) said elbowed connecting rods being disposed therein in said conduit, (c) a slot formed at the rear face of said body and extending to the interior of the conduits, and (d) a cap closing off said slot after the insertion of said elbowed connecting rods into said conduits through said slot.

* * * * *